US005244309A

United States Patent [19]

Murdock

[11] Patent Number: 5,244,309

[45] Date of Patent: Sep. 14, 1993

[54] FLUID FLOW RELEASE REGULATING DEVICE

[76] Inventor: Neil C. Murdock, 31 Terrace Dr., So. Nyack, N.Y. 10960

[21] Appl. No.: 846,551

[22] Filed: Mar. 5, 1992

[51] Int. Cl.[5] ..... E02B 7/44

[52] U.S. Cl. ..... 405/91; 405/87; 405/114; 405/115

[58] Field of Search ..... 405/115, 107, 91, 94, 405/24, 21, 114, 87

[56] References Cited

U.S. PATENT DOCUMENTS

| | | | |
|---|---|---|---|
| 2,609,666 | 9/1952 | Mesnager | 405/115 |
| 3,967,453 | 7/1976 | Bauzil | 405/115 |
| 4,787,774 | 11/1988 | Grove | 405/115 X |
| 5,007,766 | 4/1991 | Freed et al. | 405/24 |
| 5,069,579 | 12/1991 | Burns | 405/21 X |

FOREIGN PATENT DOCUMENTS

| | | | |
|---|---|---|---|
| 0571541 | 9/1977 | U.S.S.R. | 405/115 |
| 0675124 | 8/1979 | U.S.S.R. | 405/115 |

*Primary Examiner*—Dennis L. Taylor

[57] ABSTRACT

A self supporting rubbery flow blocking device of substantial thickness is mounted in a fluid passageway to automatically regulate flow. Due to its variable elastic stiffness, increases in pressure will cause the device to begin to flex away from the pressure, beginning at its free end. Further increases in pressure will cause the location of the flex to move towards the secured edge of the invention, unblocking larger areas of flow. Decreases in pressure will allow the invention to increase its blocked area until it regains its fully blocking state.

6 Claims, 3 Drawing Sheets

FLUID FLOW RELEASE REGULATING DEVICE

BACKGROUND OF THE INVENTION

1) Field of the Invention

This invention relates in general to fluid flow control devices and specifically to fluid flow control where incoming volume fluctuates.

2) Prior Art

Reservoirs & impoundments typically strive to retain maximum fluid levels for either storage or gravitational potential energy. For dams and weirs with fixed crests and natural volume inflow from rivers, streams, etc. increased inflow may cause undesirable flooding upstream of the dam or weir. Many devices have been used to regulate outflow to compensate for inflow variations. One such device is known as the steel pin flashboard, consisting of vertical steel pins, set into sockets on the crest of a dam, supporting horizontal wood planks or other such waterproof material that increases the effective height of the dam. As fluid level increases the pressure against the steel pins also increases until they bend over, allowing greater outflow from the impoundment.

Other devices use hydraulic cylinders to raise and lower hinged panels attached to the crest. Another variation is to use air or water to fill bags attached to the crest and alter the outflow by either filling or exhausting said bags.

Steel pin flashboards, once bent get washed away or remain down until flood levels recede enough to allow manual replacement. Hydraulically operated and air or water filled devices all rely on some form of external power for operation and all utilize an internal pressurized fluid to raise or lower their height and thereby the fluid level. Should loss of this internally pressurized fluid occur, sudden and dangerously unexpected flooding downstream of the impoundment is a possible consequence.

U.S. Pat. No. 4,787,774 utilizes cantilever mounted leaf springs to support a flexible impermeable membrane. Increased fluid pressure causes said leaf springs to deflect, allowing increased fluid flow over the membrane. However, any damage to the membrane will cause an opening to occur at least as wide as the spacing between the leaf springs. When in the fully lowered position bulges are created in the membrane by the leaf springs. These bulges subject the membrane in those locations to increased damage from large water born debris such as logs, ice sheets, etc.. Furthermore, the exposure of the bending element to the environment results in degradation of the bending element over time. Finally, by initiating the bend at the base, the exposed free end of the device will be impacted by water born debris normal to its plane, with possible damage occurring to the membrane.

Whatever the merits of the previously described devices, none of them fully achieves the advantages of the current invention.

Accordingly, it is a principle object of the invention to provide a novel, simple and durable device that when installed in a fluid passageway will automatically assume a blocking or unblocking position in response to changes in fluid pressure. This reaction shall occur without pumps, blowers, electrically or mechanically driven devices, sensors, wiring, piping, external springs, etc.

It is another object of this invention to be extremely resistant to punctures, tears, acts of vandalism including gunshot and knife cuts, and the damage possible from large water born debris and ice sheets. Should damage be inflicted on the device, any portion not damaged will continue to operate in its normal mode. Due to its construction, any portion of the device which is whole along an axis perpendicular to its support will be able to operate normally and independently should it become separated from any other portion of the device.

It is another object of the invention to flex from the top down in response to increased fluid pressure, thereby assuring any floating debris will strike tangentially to the device.

SUMMARY OF THE INVENTION

In its preferred embodiment, the invention is a fluid flow release regulating device that provides maximum fluid retention in its blocking position and automatically deflects itself in response to fluid pressures higher than desired. When fluid pressures begin to drop after such an occurrence, the device will begin to regain its blocking position until it again achieves its full blocking position. This is achieved by securing a variable stiffness, internally supported and elastically reinforced, rubbery elastomeric construct to a support structure by use of a clamping device. Increased fluid level raises fluid pressure on the upstream side of the construct. This increase causes the construct to flex away from the pressure. By creating a construct with increasing stiffness towards its secured edge, flexing starts closer to its free edge and causes the location of the flex to move closer to its secured edge with higher fluid pressures, allowing increased flow through the previously blocked area. Flexing stores potential energy in the rubbery elastomeric material and its integral elastic stiffening elements. Decreasing fluid levels on the upstream side of the construct also decrease fluid pressures. The decreased fluid pressure allows the device to regain more of a blocking position by moving the flex location away from its secured edge, releasing some of its stored potential energy, until a new equilibrium position is reached. This will continue until the device regains its full blocking position.

DESCRIPTION OF THE PREFERRED EMBODIMENT

Figure 1:
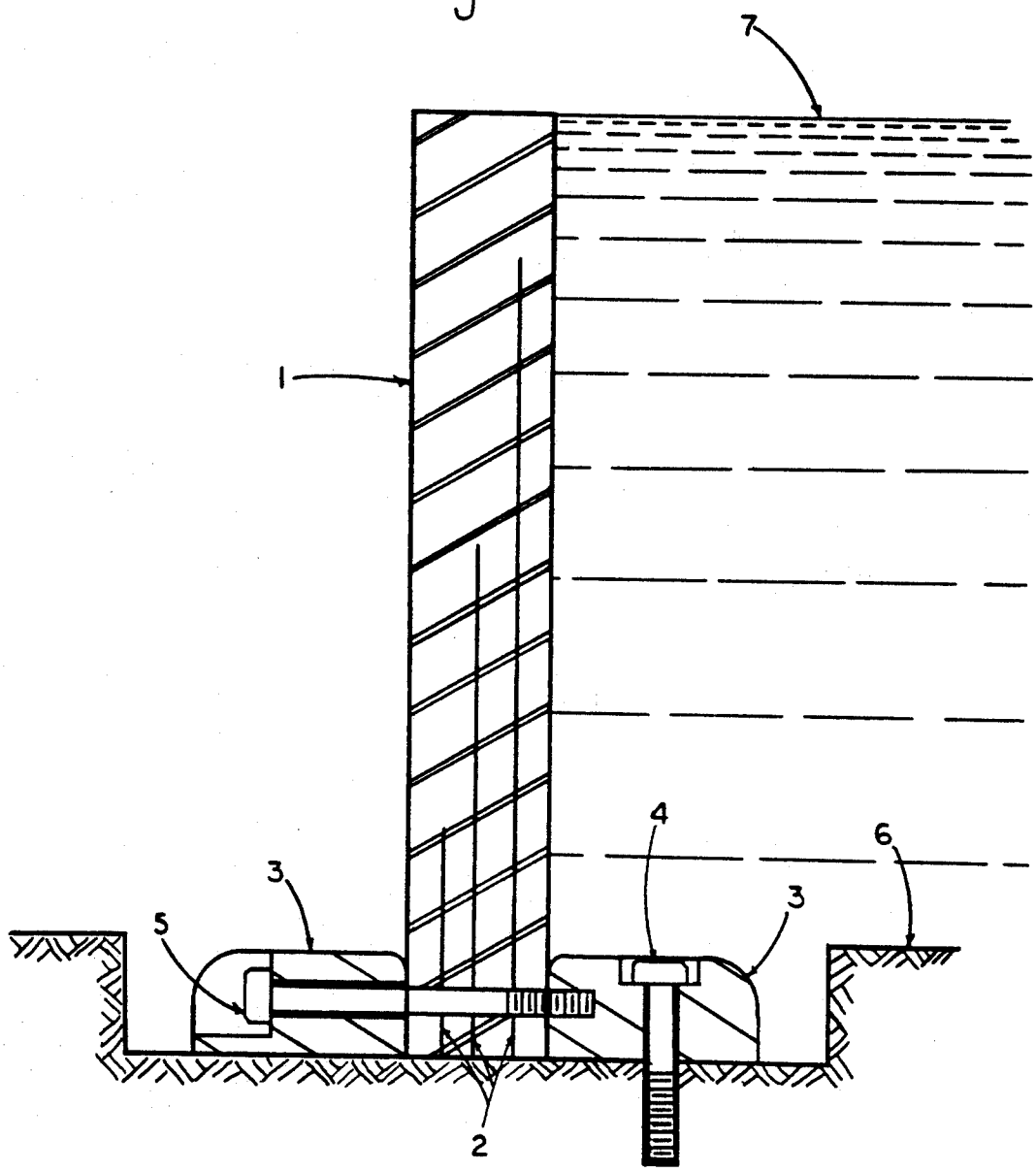
FIG. 1 is a cross sectional drawing showing the elastic reinforcements and a clamping device. The device is in its blocking position.
Figure 2:
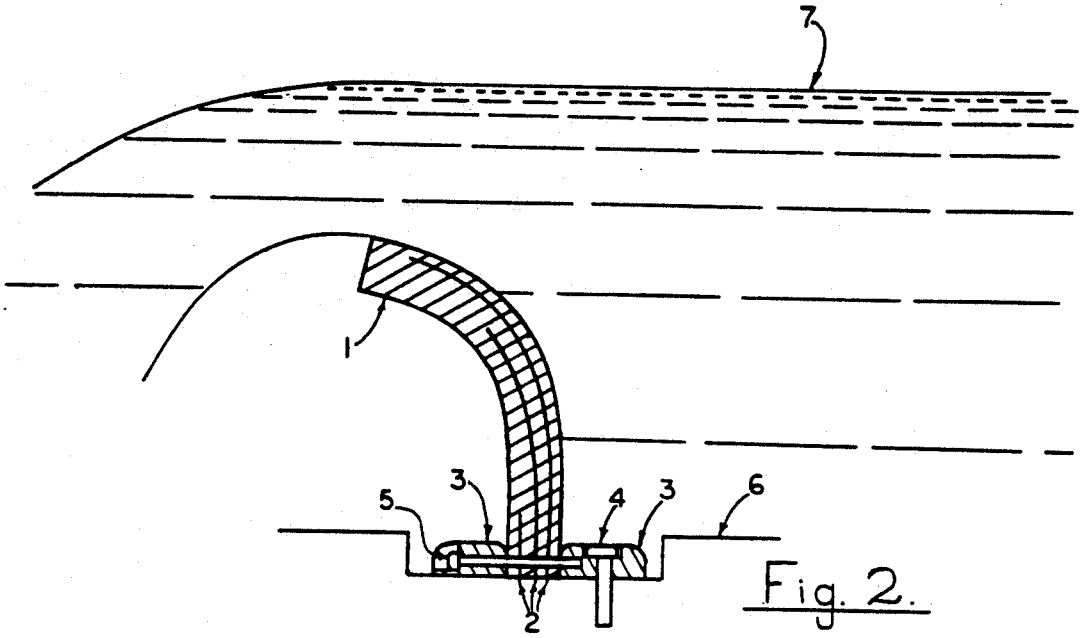
FIG. 2 is also a cross sectional drawing showing the device in a partially flexed position, allowing greater fluid flow than in FIG. 1.
Figure 3:
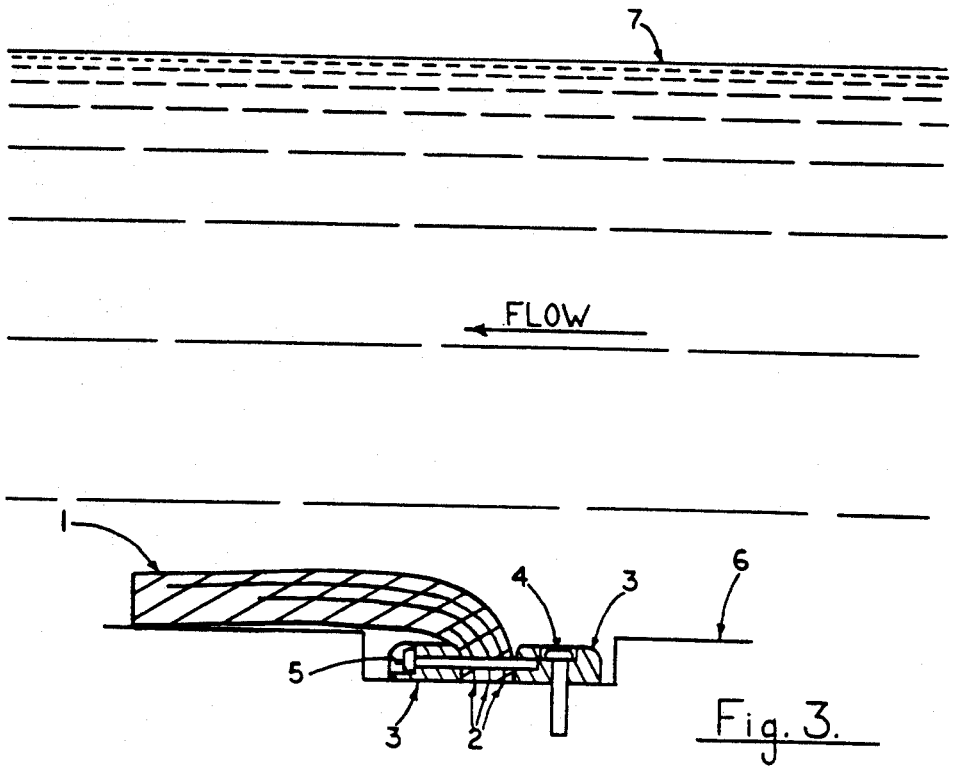
FIG. 3 is the same cross section fully flexed at or above full design fluid level and or pressure, allowing maximum flow through the previously blocked area.
Figure 4:
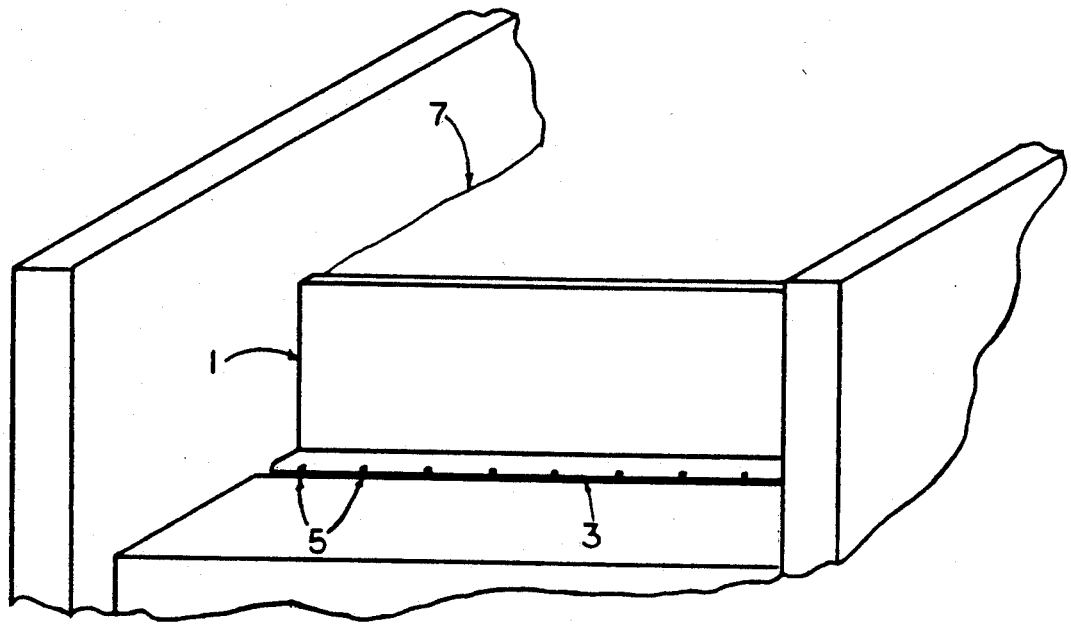
FIG. 4 is a general view of a dam crest with an embodiment of the invention mounted on it.

Refer now to FIG. 1 which is a cross sectional view of a preferred embodiment of the internally supported fluid flow release regulating device for mounting in a fluid passageway. The invention comprises a main body 1 which has a rubbery elastomeric component of a fluid blocking nature such as any of the elastomeric compounds, and has substantial thickness so that damage from water born debris or casual acts of vandalism will not seriously alter its fluid blocking nature. The main body 1 has sufficient elastic internal resistance to flexing to remain in a blocking position to fluid flow while subjected to pressures up to a given design fluid pressure and pliant enough to flex away from the fluid pressure unblocking all or part of the fluid flow, while subjected to fluid pressure at some point greater than the given design fluid pressure. The main body 1 may have uniform cross section. The main body 1 may contain and protect elastic stiffening elements 2 so placed as to increase elastic resistance to flexing. The elastic stiffening elements 2 may be continuously positioned along an perpendicular to the fixed axis and may consist of a plurality of layers along the axis parallel to flow while in a relaxed state, so that a rip or tear in the device shall only effect those portion where the elastic reinforcements are actually damaged, allowing the remainder of the device to continue normal function. It is contemplated that cuts completely through the main body 1, an perpendicular to the fixed edge will only allow negligible amount of fluid to seep through the main body. It is contemplated than embodiments of this elastic reinforcement 2 can be woven similar to that used in conveyor belts, or formed by extruded rods, may have varying cross section, be monofilament fibers, or some form of rolled process gridwork similar to that used in construction debris fence, or any combination thereof. The elastic stiffening element may even be placed into voids in the main body so as to be of removable nature. It is only necessary that the elastic stiffening element 2 be elastic in nature, capable of storing and releasing energy in flex, and be internal to and protected by the rubber elastomeric portion of the main body 1. Different lengths of elastic stiffening elements 2 as seen in FIG. 1 show one way of contributing to varying elastic resistance to flexing along an axis perpendicular to the fixed edge of the main body 1 and greater at its fixed edge than at its free edge. One of the purposes of this variation in elastic flexing resistance is to allow the main body 1 to flex at different locations along an axis perpendicular to its fixed edge, starting at its free edge, and moving towards its fixed edge with increased fluid pressure. FIGS. 2 and 3 illustrate different fluid levels with corresponding differences in fluid pressures and their influence on the location of the flex in the main body 1. By beginning the flex of the invention at its free edge, floating debris will be more able to strike the invention tangentially than if it began to flex at its base, thereby decreasing potential for damage. With decreases in the fluid level and/or pressure an already flexed device will seek to find a new equilibrium position by releasing the stored energy in the main body 1 and elastic stiffening elements 2, thereby moving the flex location away from the secured edge until the elastic resistance to flexing at the new location is again balanced by the fluid pressure, achieving a more blocking position to flow. This process will continue until the fluid level and/or pressure drop to a design level and the main body regains its fully blocking position. The varying location of flex points along the main body 1 contribute to increases and decreases in fluid flow past the device resulting in the fluid level 7 being more stable than if the device were not used.

The main body 1 can be firmly and hermetically attached by at least one edge to a structure 6 by a clamping and anchoring method such as squeezing the main body 1 between two clamping pieces 3 and securing them with a fastener 5. The clamping pieces 3 may be anchored to the structure 6 by an anchoring device 4 such as an epoxy set bolt or equivalent. The anchoring method shall position said rubbery elastomeric component such that in its relaxed state said rubbery elastomeric component shall be in a position blocking flow greater than in its flexed state. Of course, other forms of attachment can achieve the same result.

While there have been shown and described what are considered to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. An internally supported fluid flow release regulating device for mounting in a fluid passageway comprising:

a rubbery elastomeric component of substantial thickness with at least one free edge and one edge firmly secured to a supporting surface, said component having sufficient elastic internal resistance to flexing to remain in a blocking position to fluid flow while subjected to pressures up to a given design pressure, and pliant enough to flex away from the fluid pressure, unblocking all or part of the fluid flow while subjected to a fluid pressure at some point greater than the given design fluid pressure;

means anchoring said rubbery elastomeric component to said supporting surface, said means for anchoring also positioning said rubbery elastomeric component such that in its relaxed state said rubbery elastomeric component be in a position blocking flow greater than in its flexed state.

2. The internally supported fluid flow release regulating device of claim 1 wherein the said elastic internal resistance to bending is greater at its secured edge than at its free edge.

3. The internally supported fluid flow release regulating device of claim 2 wherein the rubbery elastomeric component is further comprised of internal elastic stiffening elements so placed as to increase elastic resistance to bending.

4. The internally supported fluid flow release regulating device of claim 3 wherein the internal elastic stiffening elements are comprised of varying lengths of elastic reinforcement material.

5. The internally supported fluid flow release regulating device of claim 3 wherein the internal elastic stiffening elements are comprised of elastic reinforcement material of varying cross section.

6. The internally supported fluid flow release regulating device of claim 3 wherein the elastic stiffening elements may be placed into voids in the main body so as to be of a removable nature.

* * * * *